US008042499B2

(12) United States Patent
Lee

(10) Patent No.: US 8,042,499 B2
(45) Date of Patent: Oct. 25, 2011

(54) COOLANT CIRCULATION CIRCUIT FOR ENGINE

(75) Inventor: Bong Sang Lee, Suwon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 421 days.

(21) Appl. No.: 12/274,990

(22) Filed: Nov. 20, 2008

(65) Prior Publication Data

US 2009/0151658 A1 Jun. 18, 2009

(30) Foreign Application Priority Data

Dec. 14, 2007 (KR) ..... 10-2007-0131670

(51) Int. Cl.
*F01P 7/14* (2006.01)

(52) U.S. Cl. ..... 123/41.09; 123/41.31; 123/41.02; 236/34.5

(58) Field of Classification Search ..... 123/41.31, 123/41.09, 41.08, 41.02, 41.48, 41.44, 41.33, 123/41.32, 41.13, 554; 236/101 C, 34.5, 236/12.13

See application file for complete search history.

(56) References Cited

U.S. PATENT DOCUMENTS

| | | | | |
|---|---|---|---|---|
| 4,561,387 | A * | 12/1985 | Korkemeier et al. | 123/41.31 |
| 4,745,885 | A * | 5/1988 | Koinuma | 123/41.05 |
| 4,934,341 | A * | 6/1990 | Otsuka et al. | 123/41.31 |
| 6,182,616 | B1 * | 2/2001 | Itoh et al. | 123/41.1 |
| 6,592,046 | B2 * | 7/2003 | Suda | 236/34.5 |
| 6,761,321 | B2 * | 7/2004 | Takahashi | 236/34.5 |

* cited by examiner

*Primary Examiner* — Michael Cuff
*Assistant Examiner* — Hung Q Nguyen
(74) *Attorney, Agent, or Firm* — Morgan, Lewis & Bockius LLP

(57) ABSTRACT

A coolant circulation circuit for an engine includes a first coolant line through which coolant heated in an engine and circulated in a radiator passes, a second coolant line through which coolant heated in the engine and circulated in additional elements passes, a bypass coolant line through which coolant heated in the engine passes, a coolant outlet where the coolant flows into the engine, a first chamber where the coolant having passed through the bypass coolant line flows in, a second chamber where the coolant having passed through the second coolant line flows in, a partition formed between the first chamber and the second chamber and a thermostat selectively blocking the first chamber from the second chamber.

12 Claims, 6 Drawing Sheets

COOLANT CIRCULATION CIRCUIT FOR ENGINE

CROSS-REFERENCE TO RELATED APPLICATION

This application claims priority to and the benefit of Korean Patent Application No. 10-2007-0131670 Dec. 14, 2007, the entire contents of which applications is incorporated herein for all purposes by this reference.

BACKGROUND OF THE INVENTION

1. Field of the Invention

The present invention relates to a coolant circulation circuit for an engine. More particularly, the present invention relates to a coolant circulation circuit for an engine that may enhance thermo-sensitivity of a thermostat, and minimize temperature differences in coolant circulation circuit.

2. Description of Related Art

A cooling system for an engine is divided to an air-cooled type of system and a water-cooled type of system.

Conventional water-cooled systems cool an engine by circulating a coolant to a water jacket that is formed between a cylinder block and a cylinder head.

The conventional water cooled system includes a radiator that radiates heat of coolant to the air, a water pump that circulates coolant, and a thermostat that is opened/closed automatically according to changes in temperature in order to adjust coolant flow to the radiator for keeping the coolant temperature in predetermined ranges.

As shown in FIG. 6, in a conventional coolant circulation circuit for an engine, coolant that is circulated and heated in an engine 100 passes by a thermostat 102 and then flows to a radiator 104.

The coolant is cooled in the radiator 104 by air passed by a cooling fan (not shown), flows into an engine by a water pump (not shown), and cools the engine 100.

A part of the coolant is supplied to a heater 106 or additional elements 108, for example a throttle valve and a turbocharger, and returns to the engine 100 through a lower part of the radiator 104. However, the coolant passed by the additional elements 108 passes near the thermostat 102 and returns to the engine 100 because of a limited space of an engine room, and thus, the coolant passed by the additional elements 108 interferes in detecting temperatures, so that the thermostat 102 may not detects temperature differences in the coolant circulation circuit.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention have been made in an effort to provide a coolant circulation circuit for an engine that may supplement the temperature of an engine by a temperature of bypassed coolant allowing thermostat to block a bypass coolant line. Also, various aspects of the present invention have been made in an effort to provide a coolant circulation circuit for an engine that may prevent pressure from rising according to stagnation of coolant and prevent sediment from accumulating.

One aspect of the present invention is directed to a coolant circulation circuit for an engine including a first coolant line through which coolant heated in an engine and circulated in a radiator passes, a second coolant line through which coolant heated in the engine and circulated in an additional element passes, a bypass coolant line through which a portion of coolant heated in the engine passes, a first chamber where the coolant having passed through the bypass coolant line flows in, a second chamber where the coolant having passed through the second coolant line flows in, a coolant outlet where the coolant flows back into the engine, a partition formed between the first chamber and the second chamber, and/or a thermostat selectively blocking the first chamber from the second chamber.

The second chamber may be formed by an outer case and fluidly communicates with the second coolant line, and a gap connecting the first chamber with the second chamber may be formed between the bypass coolant line and the partition. The additional element may include a throttle. The additional element may include a turbocharger.

Another aspect of the present invention is directed to a coolant circulation circuit for an engine including a coolant circulation control apparatus including a thermostat, a first output line fluidly connecting an engine and a radiator, a second output line fluidly connecting the first output line and additional element, a first coolant line through which coolant heated in the engine and circulated in the radiator through the first output line flows out, a second coolant line through which coolant heated in the engine and circulated in the additional element through the second output line flows out and directly flows back into to the engine through the coolant circulation control apparatus, a bypass coolant line that branches from the first output line and through which a portion of coolant heated in the engine flows into the coolant circulation control apparatus, and/or a coolant outlet formed at the coolant circulation control, through which coolant flown into the coolant circulation control apparatus through the second coolant line and the first coolant line or bypass coolant line flows into the engine. The coolant circulation control apparatus may selectively connect the first coolant line or bypass coolant line with the coolant outlet.

The additional element may include a throttle. The additional element may include a turbocharger. The coolant circulation circuit may further include a heater configured to be fluidly connected between the first output line and the second coolant line. The coolant circulation control apparatus may include a first chamber fluidly connecting the bypass coolant line, a second chamber enclosing the first chamber and fluidly connected to the first coolant line, the second coolant line, and the coolant outlet, and/or the thermostat selectively blocking the first chamber from the coolant outlet or the first coolant line from the coolant outlet according to a temperature of coolant. A partition may be formed between the first chamber and the second chamber, and the second chamber may be enclosed by an outer case. A gap fluidly connecting the first chamber with the second chamber may be formed between the bypass coolant line and the partition.

A further aspect of the present invention is directed to a coolant circulation circuit system for an engine including a coolant circulation control apparatus including a thermostat, a first output line fluidly connecting an engine and a radiator, a second output line fluidly connecting the first output line and additional element, a first coolant line through which coolant heated in the engine and circulated in the radiator through the first output line flows out, a second coolant line through which coolant heated in the engine and circulated in the additional element through the second output line flows out and directly flows back into to the engine through the coolant circulation control apparatus, a bypass coolant line that branches from the first output line and through which a portion of coolant heated in the engine flows into the coolant circulation control apparatus, and/or a coolant outlet formed at the coolant circulation control, through which coolant flown into the coolant circulation control apparatus through the second coolant line and the first coolant line or bypass coolant line flows into the engine. The coolant circulation control apparatus may selectively connect the first coolant line or bypass coolant line with the coolant outlet.

The additional element may include a throttle. The additional element may include a turbocharger. The coolant circulation control apparatus may include a first chamber fluidly connecting the bypass coolant line, a second chamber enclosing the first chamber and fluidly connected to the first coolant line, the second coolant line, and the coolant outlet, and/or the thermostat selectively blocking the first chamber from the coolant outlet or the first coolant line from the coolant outlet according to a temperature of coolant. A gap fluidly connecting the first chamber with the second chamber may be formed between the bypass coolant line and the partition.

A passenger vehicle may include any of the coolant circulation circuit systems described above. The system may further include a first chamber fluidly connecting the bypass coolant line, a second chamber enclosing the first chamber and fluidly connected to the first coolant line, the second coolant line, and the coolant outlet, and/or the thermostat selectively blocking the first chamber from the coolant outlet or the first coolant line from the coolant outlet according to a temperature of coolant. A gap fluidly connecting the first chamber with the second chamber may be formed between the bypass coolant line and the partition.

According to various aspects of the present invention, a portion of the coolant that passes by a bypass coolant line may contact a thermostat after an engine warms up and the bypass coolant line is closed, so that the temperature of the engine may be supplemented. Also, a portion of the coolant within the bypass coolant line may flow out so that pressure rising according to stagnation of coolant may be prevented and accumulation of sediment may be prevented.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
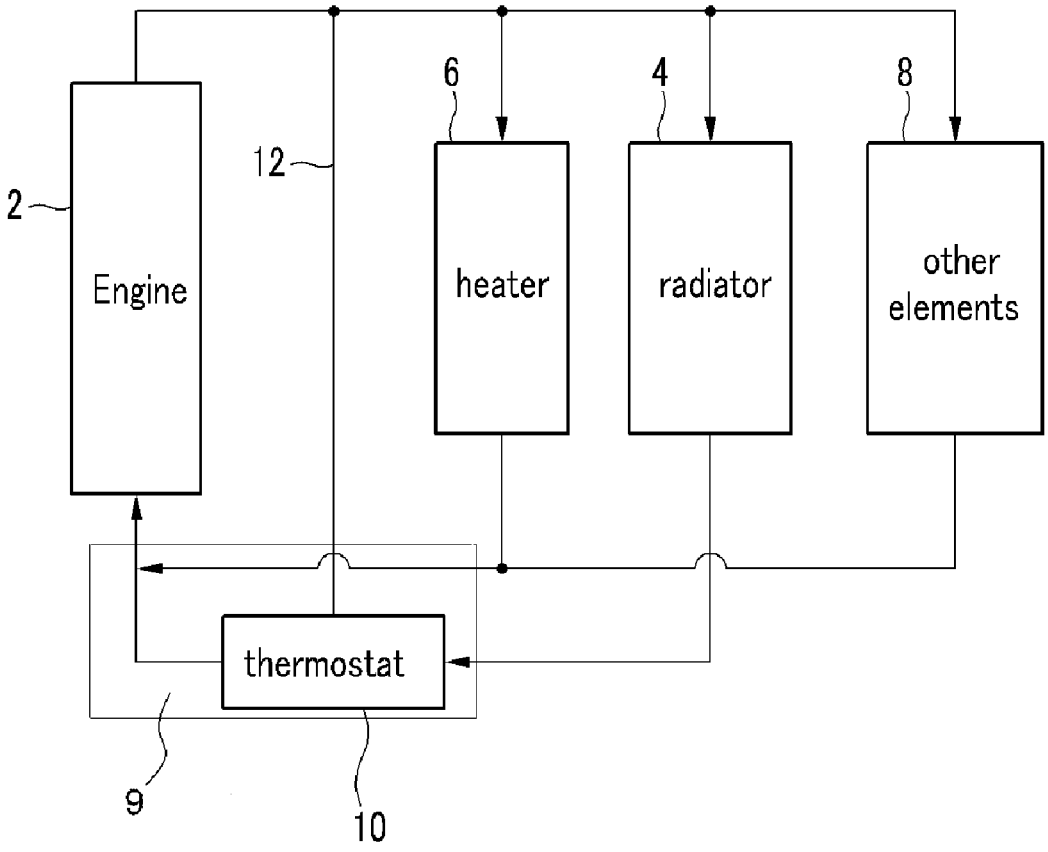
FIG. 1 is a schematic diagram of a coolant circulation circuit for an engine in accordance with the present invention.
Figure 2:
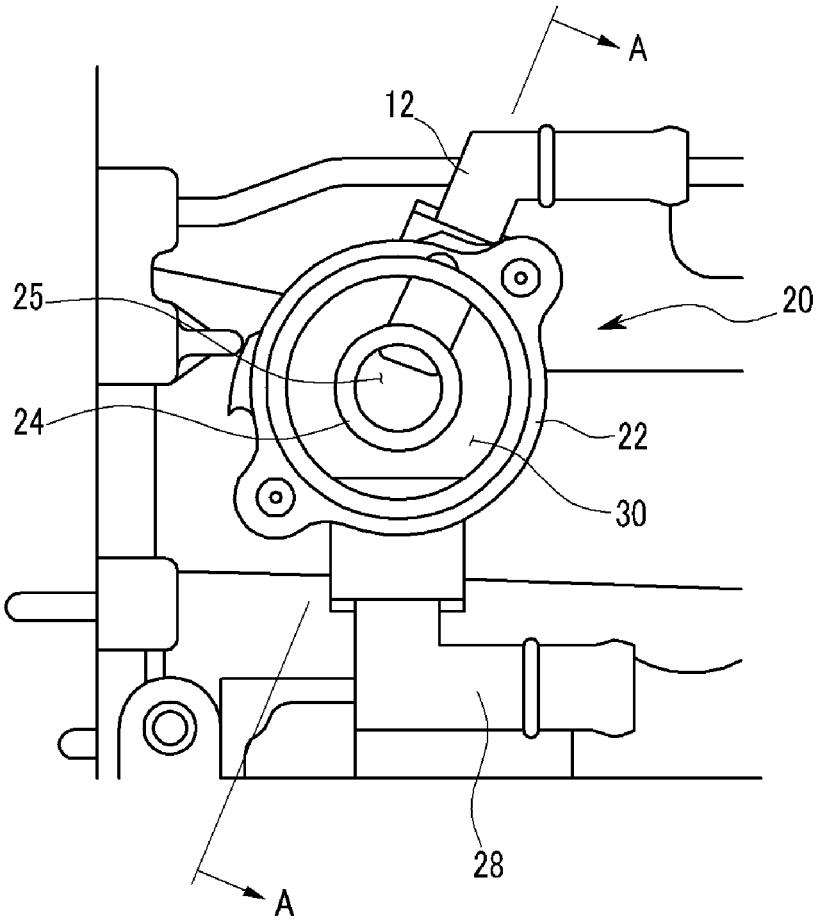
FIG. 2 is a plain view showing a thermostat lower housing of a coolant circulation circuit for an engine in accordance with the present invention.

FIG. 1 is a schematic diagram of a coolant circulation circuit for an engine according to an exemplary embodiment of the present invention.

Coolant circulated and heated in an engine 2 flows into a radiator 4, a heater 6, and additional elements 8 including a throttle and a turbocharger and so on.

Flow of coolant supplied from the radiator 4 to the engine 2 is regulated by a coolant circulation control apparatus 9, and coolant supplied to the additional elements 8 returns to the engine 2 directly.

A part of the coolant flowing out the engine 2 may flow into the coolant circulation control apparatus 9 through a bypass coolant line 12 and the coolant circulation control apparatus 9 regulates the flow of the coolant in the bypass coolant line 12 according to temperature of the coolant.

Accordingly the coolant circulation control apparatus 9 controls the coolant flow in the bypass coolant line 12 and the radiator 4.

The thermostat 10 of the coolant circulation control apparatus 9 is a device well-known for regulating the temperature of a system so that the system's temperature is maintained near a desired set point temperature. Accordingly the detailed explanation about the thermostat 10 is omitted.

In various embodiments of the present invention, when the engine 2 is not sufficiently warmed up, the coolant circulation control apparatus 9 controls the coolant to circulate via the bypass coolant line 12 and close the radiator 4 so that coolant passing through the bypass coolant line 12 returns to the engine 2. In contrast, the bypass coolant line 12 is controlled to be closed but the radiator 4 is controlled to be opened by the coolant circulation control apparatus 9 when the engine 2 warms up so that coolant passing through the radiator 4 returns to the engine 2.

FIG. 2 to FIG. 5 illustrates the coolant circulation control apparatus 9 for an engine according to an exemplary embodiment of the present invention. The coolant circulation control apparatus 9 includes a thermostat 10, a thermostat lower housing 20, and a partition 24 formed inside of an outer case 22 where the coolant circulation control apparatus 9 is disposed.

The thermostat 10, in various embodiments of the present invention, includes a lower valve plate 32, an upper valve plate 33 and a body 35. The body 35 of the thermostat 10 is fixed to the outer case 22, the lower valve plate 32 is movably mounted on the partition 24 and the upper valve plate 33 is movably mounted on an upper portion of the outer case 22. Accordingly, the lower valve plate 32 and the upper valve plate 33 may move in the opposite direction with respect to the body 35 according to temperature.

The bypass coolant line 12 is inserted into the partition 24 through a lateral side thereof, and the outer case 22 is connected with a second coolant line 28.

The second coolant line 28 is connected with the additional elements 8.

A first chamber 25 is formed by the partition 24 and fluidly communicates with the bypass coolant line 12, and a second chamber 30 is formed between the partition 24 and the outer case 24 and fluidly communicates with the second coolant line 28.

A first coolant line 27 through which the coolant heated in the engine 2 and circulated in the radiator 7 passes is disposed to the second chamber 30 of the thermostat lower housing 20.

The thermostat 10 of coolant circulation control apparatus 9 opens or closes the partition 24 by a lower valve plate 32 and opens or closes the first coolant line 27 by the upper valve plate 33 according to coolant temperature. The coolant within the thermostat lower housing 20 returns to the engine 2 through a coolant outlet 34 formed in the outer case 22.

Figure 3:
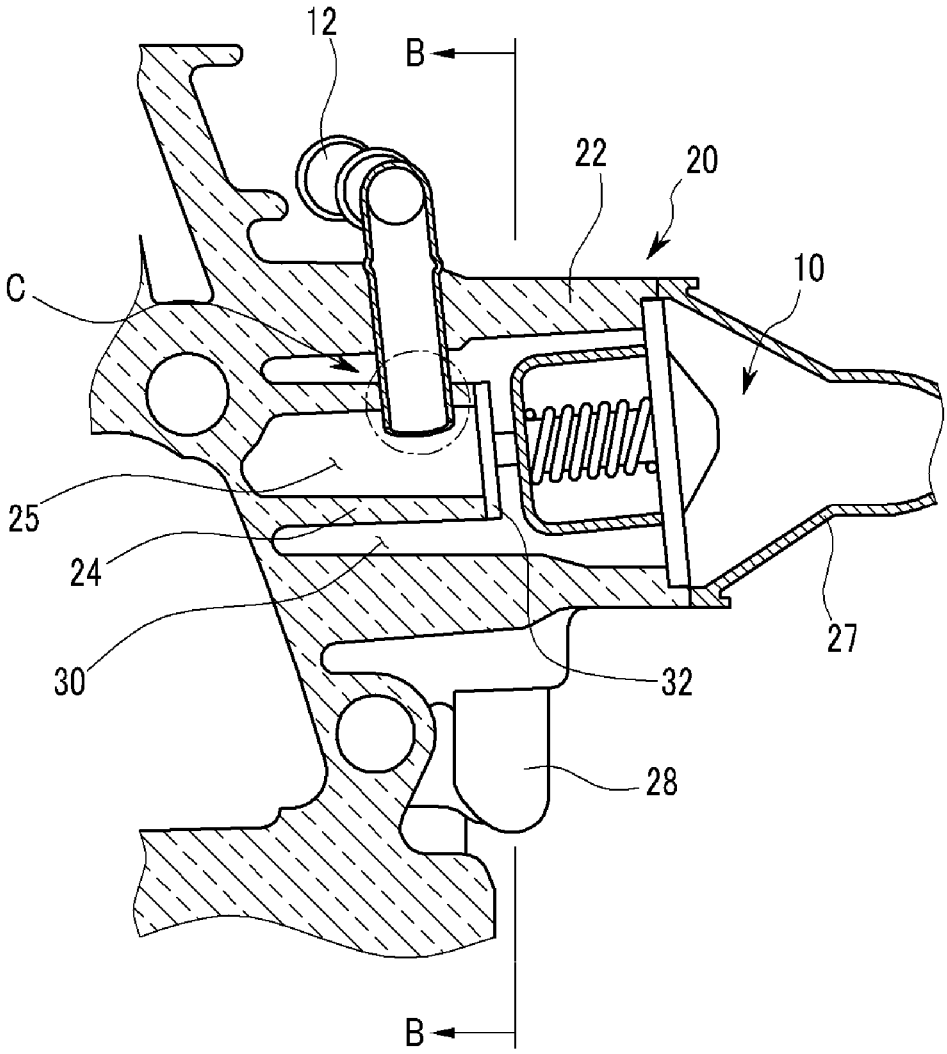
FIG. 3 is a cross-sectional view of the thermostat lower housing along a line A-A in FIG. 2.
Figure 4:
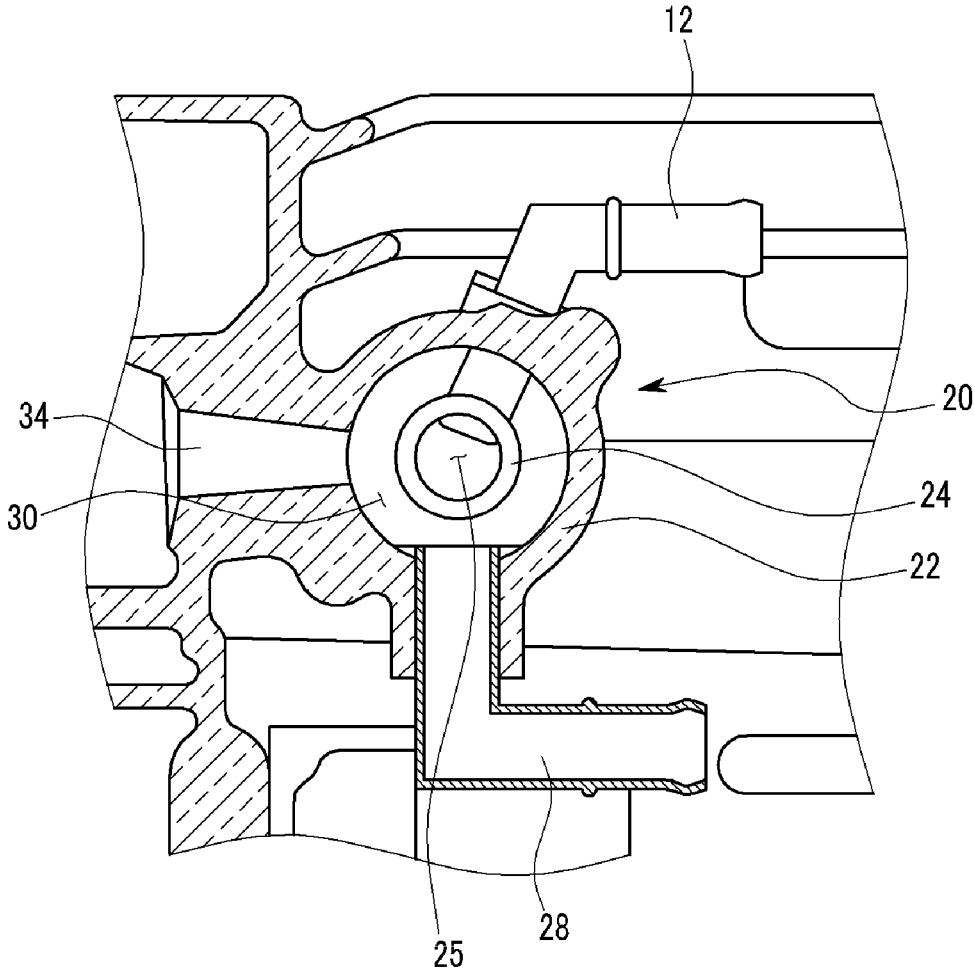
FIG. 4 is a cross-sectional view the thermostat lower housing along a line B-B in FIG. 3.
Figure 5:
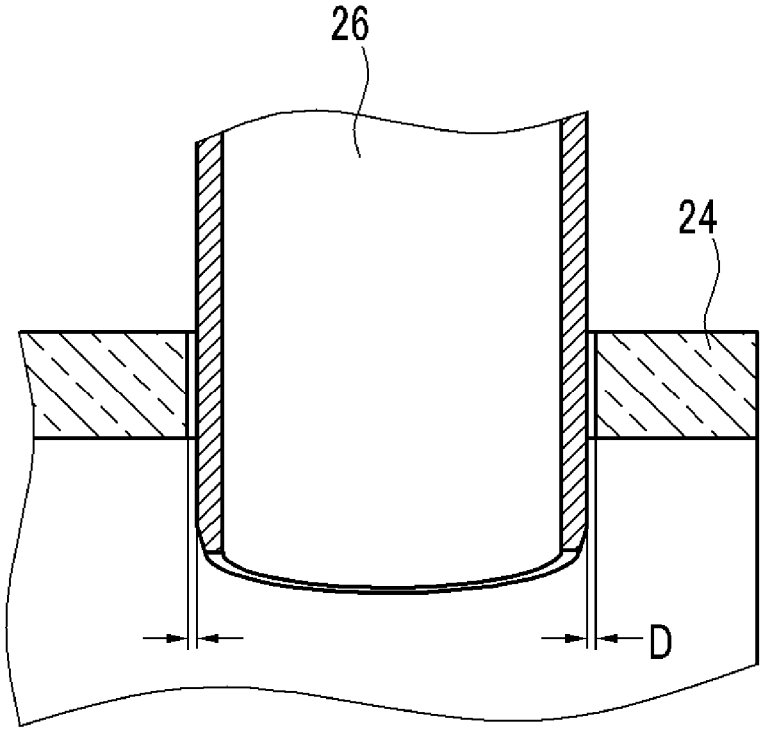
FIG. 5 is an expanded cross-sectional view of detail C in FIG. 3.
Figure 6:
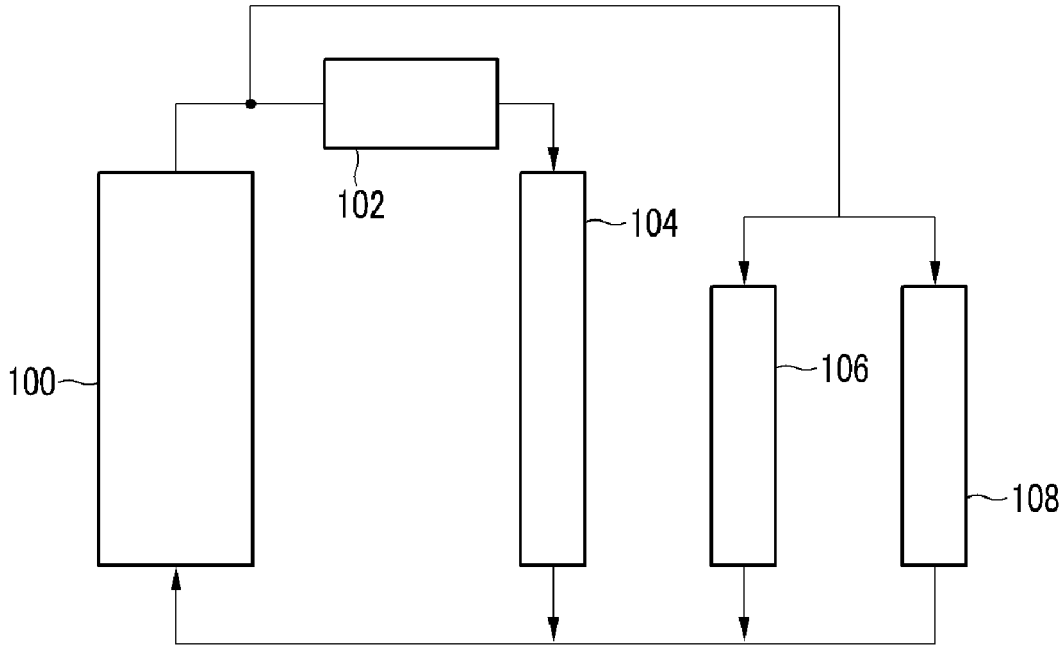
FIG.6 (Prior Art)
FIG. 6 is a schematic diagram of a conventional coolant circulation circuit for an engine.

In detail, referring FIG. 3, the first coolant line 27 through which the coolant heated in the engine 2 and circulated in the radiator 7 passes is configured to be connected with the second chamber 30 as the upper valve plate 33 opens the passage between the second chamber 30 and the first coolant line 27 but the lower valve plate 32 closes the passage between the first chamber 25 and the second chamber 30 as the coolant is sufficiently warmed.

Meanwhile, as the coolant is not sufficiently warmed, the upper valve plate 33 closes the passage between the second chamber 30 and the first coolant line 27 but the lower valve plate 32 opens the passage between the first chamber 25 and the second chamber 30

In the case in which the engine 2 is not warmed up, the partition 24 is opened by the lower valve plate 32 of the coolant circulation control apparatus 9 so that the coolant within the first chamber 25 flows into the second chamber 30. Accordingly, the coolant of the bypass coolant line 12 within the first chamber 25, the coolant circulated in the additional elements 8 within the second chamber 30 return to the engine 2 through the coolant outlet 34. However, the coolant of the radiator 7 does not return to the engine 2 as the upper valve plate 33 is closed.

Meanwhile in various embodiments of the present invention, a gap D may be formed between the partition 24 and the bypass coolant line 12 along a circumference of the bypass coolant line 12.

In the case in which the lower valve plate 32 of the coolant circulation control apparatus 9 closes the partition 24 after the engine warms up as set forth above, a portion of the coolant in the first chamber 25 flows into the second chamber 30 through the gap D so that the portion of the coolant of the bypass coolant line 12 within the first chamber 25, the coolant circulated in the additional elements 8 within the second chamber 30, and the coolant flown into the second chamber 30 from the radiator 7 as the upper valve plate 33 is opened, return to the engine 2 through the coolant outlet 34.

In detail, in the case in which the engine 2 warms up, the lower valve plate 32 of the coolant circulation control apparatus 9 closes the partition 24 so that circulation of the coolant within the bypass coolant line 12 is suppressed.

At this time, a portion of the coolant in the partition 24 flows into the second chamber 30 through the gap D and influences operation of the coolant circulation control apparatus 9 so that the temperature of an engine 2 may be supplemented.

Further, a pressure rise according to stagnation of the coolant within the bypass coolant line 12 may be prevented and accumulating of sediment may be prevented due to flowing of a part of the coolant in the partition 24.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

For convenience in explanation and accurate definition in the appended claims, the terms "upper" or "lower", "inside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A coolant circulation circuit for an engine comprising:

a first coolant line through which coolant heated in an engine and circulated in a radiator passes;

a second coolant line through which coolant heated in the engine and circulated in an additional element passes;

a bypass coolant line through which a portion of coolant heated in the engine passes;

a first chamber where the coolant having passed through the bypass coolant line flows in;

a second chamber where the coolant having passed through the second coolant line flows in;

a coolant outlet where the coolant flows back into the engine;

a partition formed between the first chamber and the second chamber wherein the partition forms the first coolant line; and a thermostat selectively blocking the first chamber from the second chamber;

wherein the second chamber is formed by an outer case and fluidly communicates with the second coolant line; and wherein a gap continuously connecting the first chamber with the second chamber is formed between the bypass coolant line and the partition while the bypass coolant line is fluid-connected to the first chamber.

2. The coolant circulation circuit for an engine of claim 1, wherein the additional element includes a throttle.

3. The coolant circulation circuit for an engine of claim 1, wherein the additional element includes a turbocharger.

4. A coolant circulation circuit for an engine comprising:

a coolant circulation control apparatus comprising a thermostat;

a first output line fluidly connecting an engine and a radiator;

a second output line fluidly connecting the first output line and additional element;

a first coolant line through which coolant heated in the engine and circulated in the radiator through the first output line flows out;

a second coolant line through which coolant heated in the engine and circulated in the additional element through the second output line flows out and directly flows back into to the engine through the coolant circulation control apparatus;

a bypass coolant line that branches from the first output line and through which a portion of coolant heated in the engine flows into the coolant circulation control apparatus; and a coolant outlet formed at the coolant circulation control apparatus, through which coolant flown into the coolant circulation control apparatus through the second coolant line and the first coolant line or bypass coolant line flows into the engine;

wherein the coolant circulation control apparatus selectively connects the first coolant line or bypass coolant line with the coolant outlet;

wherein the coolant circulation control apparatus includes:

a first chamber fluidly connecting the bypass coolant line;

a second chamber enclosing the first chamber and fluidly connected to the first coolant line, the second coolant line, and the coolant outlet;

a partition forming the first coolant line; and the thermostat selectively blocking the first chamber from the coolant outlet or the first coolant line from the coolant outlet according to a temperature of coolant;

wherein a gap continuously connecting the first chamber with the second chamber is formed between the bypass coolant line and the partition while the bypass coolant line is fluid-connected to the first chamber.

5. The coolant circulation circuit for an engine of claim 4, wherein the additional element includes a throttle.

6. The coolant circulation circuit for an engine of claim 4, wherein the additional element includes a turbocharger.

7. The coolant circulation circuit for an engine of claim 4, further comprising a heater configured to be fluidly connected between the first output line and the second coolant line.

8. The coolant circulation circuit for an engine of claim 4, wherein a partition is formed between the first chamber and the second chamber, and the second chamber is enclosed by an outer case.

9. A coolant circulation circuit system for an engine comprising:

a coolant circulation control apparatus including a thermostat;

a first output line fluidly connecting an engine and a radiator;

a second output line fluidly connecting the first output line and additional element;

a first coolant line through which coolant heated in the engine and circulated in the radiator through the first output line flows out;

a second coolant line through which coolant heated in the engine and circulated in the additional element through the second output line flows out and directly flows back into to the engine through the coolant circulation control apparatus;

a bypass coolant line that branches from the first output line and through which a portion of coolant heated in the engine flows into the coolant circulation control apparatus; and a coolant outlet formed at the coolant circulation control apparatus, through which coolant flown into the coolant circulation control apparatus through the second coolant line and the first coolant line or bypass coolant line flows into the engine;

wherein the coolant circulation control apparatus selectively connects the first coolant line or bypass coolant line with the coolant outlet;

wherein the coolant circulation control apparatus comprise:

a first chamber fluidly connecting the bypass coolant line;

a second chamber enclosing the first chamber and fluidly connected to the first coolant line, the second coolant line, and the coolant outlet, the thermostat selectively blocking the first chamber from the coolant outlet or the first coolant line from the coolant outlet according to a temperature of coolant; and a partition forming the first coolant line; and wherein a gap continuously connecting the first chamber with the second chamber is formed between the bypass coolant line and the partition while the bypass coolant line is fluid-connected to the first chamber.

10. The coolant circulation circuit for an engine of claim 9, wherein the additional element includes a throttle.

11. The coolant circulation circuit for an engine of claim 9, wherein the additional element includes a turbocharger.

12. A passenger vehicle comprising the coolant circulation circuit system for an engine of claim 9, and a first chamber fluidly connecting the bypass coolant line;

a second chamber enclosing the first chamber and fluidly connected to the first coolant line, the second coolant line, and the coolant outlet; and the thermostat selectively blocking the first chamber from the coolant outlet or the first coolant line from the coolant outlet according to a temperature of coolant.

* * * * *